United States Patent [19]

Murray

[11] Patent Number: 5,024,629

[45] Date of Patent: Jun. 18, 1991

[54] COIN HOLDER/DISPENSER

[76] Inventor: Darlene G. Murray, 1043 Wascana St., Regina, Saskatchewan, Canada, S4T 4H8

[21] Appl. No.: 425,223

[22] Filed: Oct. 23, 1989

[30] Foreign Application Priority Data

Jan. 10, 1989 [CA] Canada ..... 587833

[51] Int. Cl.[5] ..... G07D 1/00

[52] U.S. Cl. ..... 453/54; 206/0.84

[58] Field of Search ..... 453/45–48, 453/50–54, 60; 221/185, 279; 206/0.83, 0.84; 312/71

[56] References Cited

U.S. PATENT DOCUMENTS

| | | | |
|---|---|---|---|
| 1,787,085 | 12/1930 | Nelson | 453/45 |
| 2,654,376 | 10/1953 | Hultberg | 453/54 |
| 3,172,414 | 3/1965 | Kurz . | |
| 3,675,664 | 7/1972 | Kitowski . | |
| 3,731,695 | 5/1973 | Meijer | 453/54 |

FOREIGN PATENT DOCUMENTS

| | | | |
|---|---|---|---|
| 192436 | 10/1919 | Canada . | |
| 350984 | 6/1935 | Canada . | |
| 906445 | 8/1972 | Canada . | |
| 965058 | 3/1975 | Canada . | |
| 0530611 | 11/1957 | Italy | 453/54 |
| 0179348 | 5/1922 | United Kingdom | 453/54 |
| 1293281 | 10/1972 | United Kingdom | 453/54 |

*Primary Examiner*—F. J. Bartuska

*Attorney, Agent, or Firm*—Adrian D. Battison; Stanley G. Ade; Murray E. Thrift

[57] ABSTRACT

A coin holder/dispenser is manufactured as an integral molded body defining a plurality of side by side bores extending from the upper surface through to the lower surface of the body. Each bore is plugged at the lower end by a removable plug. A spring biases coins upwardly along the bore toward the upper surface. The upper surface is contoured to define shoulders which engage the upper surface of the uppermost coin to hold it against axial movement. A channel extending forwardly from the rearmost edge across a rear shoulder along the side shoulders guides the finger of the user to sweep a coin from its entrapped position forwardly through a slot in the front surface. The molded device is inexpensively manufactured from a limited number of parts and provides an attractive appearance and close control over the dispensing of the coins.

1 Claim, 4 Drawing Sheets

COIN HOLDER/DISPENSER

BACKGROUND OF THE INvENTION

This invention relates to a device for holding and dispensing coins of a type which is readily manually portable for dispensing of change and for storing coins received by the user.

Many people selling services or goods away from a fixed base at which a till can be located require a simple portable device to carry and dispense coins for receiving and giving change in the monetary transaction involved. While tills are ideal in a fixed location such as stores, such tills are of course not in anyway portable for use for example by waitresses, taxi drivers and others involved in such monetary transactions.

Various designs of such dispensers are available but most are merely formed of folded metal which leads to an unattractive appearance and in many cases to some difficulty in the mechanical manipulation necessary to extract coins or to insert coins for holding within the device.

SUMMARY OF THE INVENTION

It is one object of the present invention, therefore, to provide an improved holding and dispensing device of this type which is manufactured in an attractive molded appearance and which provides surfaces which effectively control the insertion and extraction of the coins for easy manual manipulation.

According to a first aspect of the invention, therefore, there is provided a device for holding and dispensing coins comprising a unitary molded body defining a plurality of cylindrical bores through the body in parallel spaced relation along the body with each bore breaking out on an upper and a lower surface of the body, each bore having a cross section which is constant along at least the majority of its length and arranged to receive and closely surround a particular denomination of coin, a plurality of plug members each arranged to cooperate with a respective one of the bores and with the lower surface of the body to removably plug a lower end of the bore, and a plurality of spring means each arranged in a respective one of the bores in engagement with the respective plug member so as to bias upwardly toward the upper surface any coins within the bore, the upper surface being molded to define for each bore breaking out thereon shoulder means for engaging an uppermost one of the coins in the bore so as to prevent axial movement of said uppermost coin out of the upper end of the bore, a front surface of the body at said upper surface being free from said shoulder means such that the uppermost coin can be slid forwardly from the bore under said shoulder means in a direction at right angles to the axis of the bore to be released from the bore for dispensing.

According to a second aspect of the invention there is provided a device for holding and dispensing coins comprising a unitary molded body defining a plurality of cylindrical bores through the body in parallel spaced relation along the body with each bore breaking out on an upper surface of the body with means plugging a lower end of each of the bores, each bore having a cross section which is constant along at least the majority of its length and arranged to receive and closely surround a particular denomination of coin, a plurality of spring means each arranged in a respective one of the bores so as to bias upwardly toward the upper surface any coins within the bore, the upper surface being molded to define for each bore breaking out thereon shoulder means at sides and a rear of the bore for engaging an uppermost one of the coins in the bore so as to prevent axial movement of said uppermost coin out of the upper end of the bore, a front surface of the body at said upper surface being free from said shoulder means such that the uppermost coin can be slid forwardly from the bore under said shoulder means in a direction at right angles to the axis of the bore to be released from the bore for dispensing, the upper surface being shaped to define a channel extending thereacross from a position adjacent to or at the rear surface toward the front surface, edges of the channel being defined by innermost edges of the shoulder means such that the channel intersects with an exposed portion of the uppermost coin.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
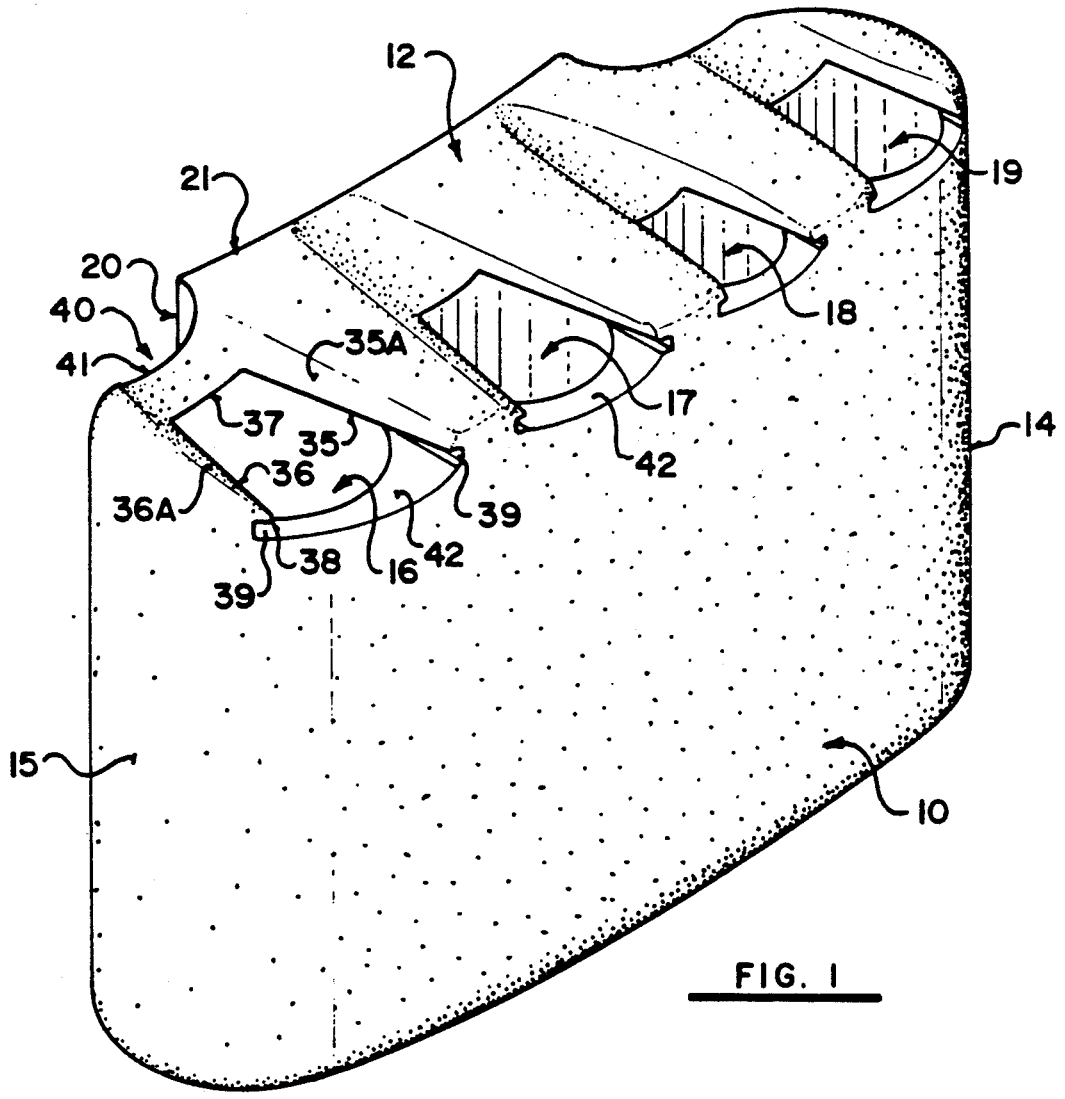
FIG. 1 is an isometric view of a coin dispensing/holding device showing a front surface and upper surface from which the coins are dispensed.

The device comprises a molded integral body which is substantially rectangular in shape defining a front surface 10, a rear surface 11, an upper surface 12 and a lower surface 13 together with curved ends 14 and 15. The device includes four separate bores 16, 17, 18 and 19 which extend through the body from the upper surface to the lower surface breaking out on both of those surfaces.

The bores are substantially of constant cross section along their length which is circular and which is dimensioned to receive a coin of a particular denomination. In the example shown, the bore 16 is designed to be suitable for a dollar coin, the bore 17 is designed to be suitable for a twenty-five cent piece, the bore 18 is designed to be suitable for a ten cent piece and the bore 19 is designed to be suitable for a five cent piece. The bores are arranged side by side across the width of the body with sufficient spacing merely for convenience of handling of the individual bores as will be explained hereinafter and to provide a suitable amount of material in the body for structural strength. The spacing of the front and rear surfaces from the bores is again sufficient for good design and appearance.

The front surface is slightly convex and the rear surface follows substantially the same shape and is accordingly slightly concave thus providing an attractive appearance and enabling the unit to be worn on the user's waist with the slight concave curvature of the rear surface following the body shape of the user. In addition a bracket 20 is provided at the rear surface supported therefrom by a flange 21 at the upper surface 12 with the bracket extending downwardly therefrom so that it can be looped over the belt of a wearer to hold the device simply in place. The bracket can of course also be looped over any other suitable support for example within a taxi cab where the device is supported on the vehicle rather than on the user.

Figure 2:
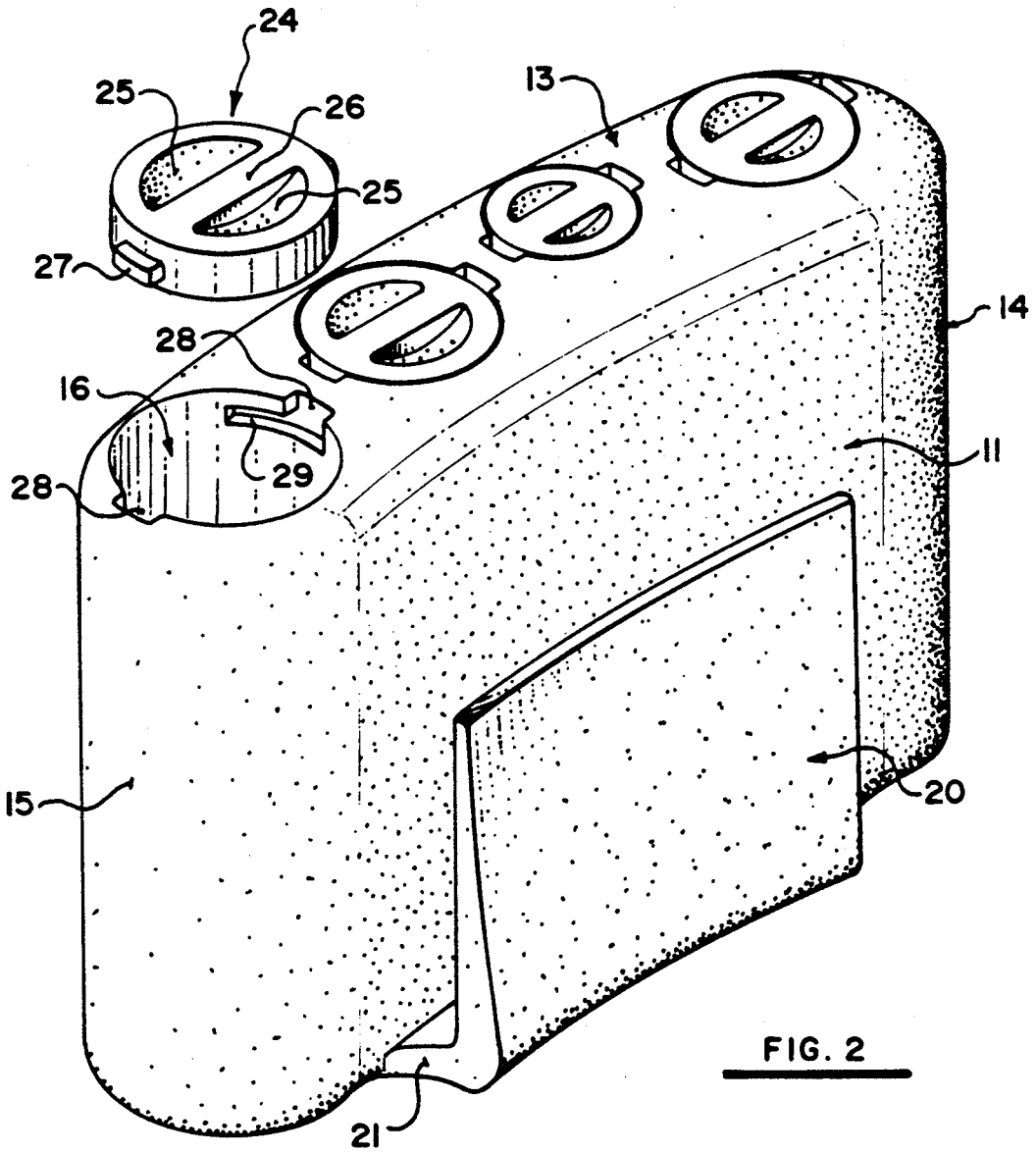
FIG. 2 is a similar isometric view of the same device which is inverted to show the rear and lower surfaces.
Figure 3:
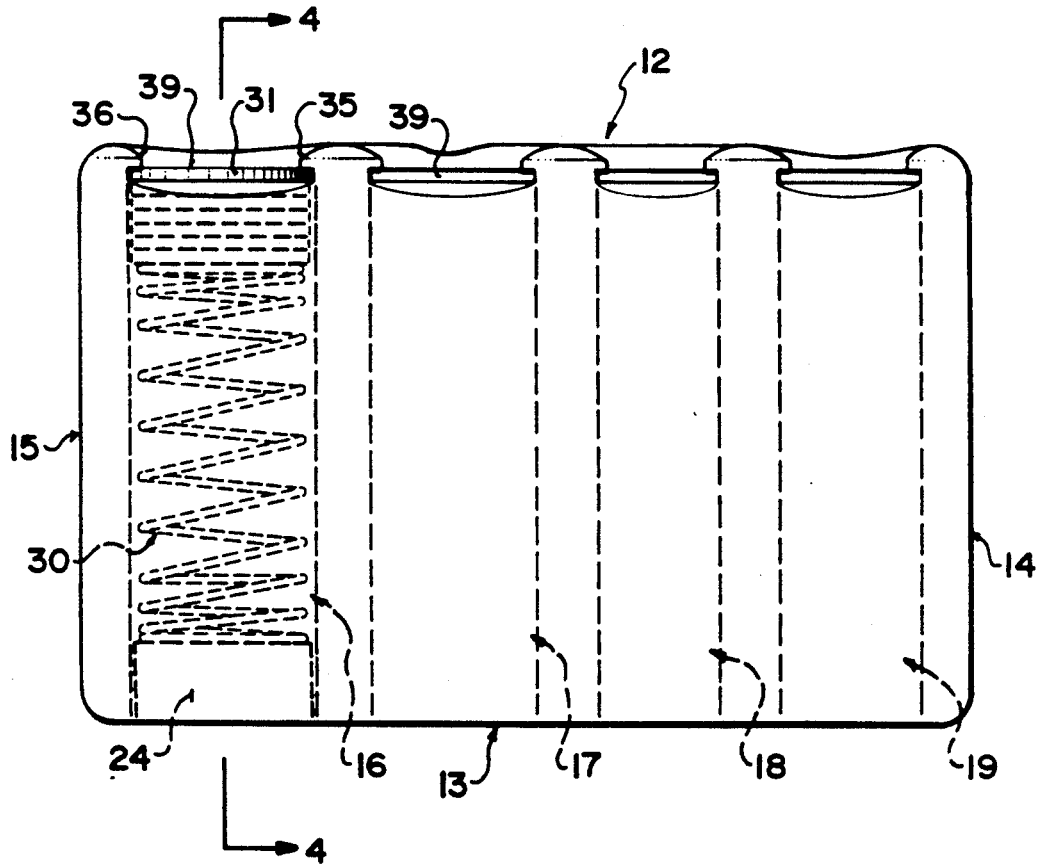
FIG. 3 is a front elevational view of the device of FIG. 1.
Figure 4:
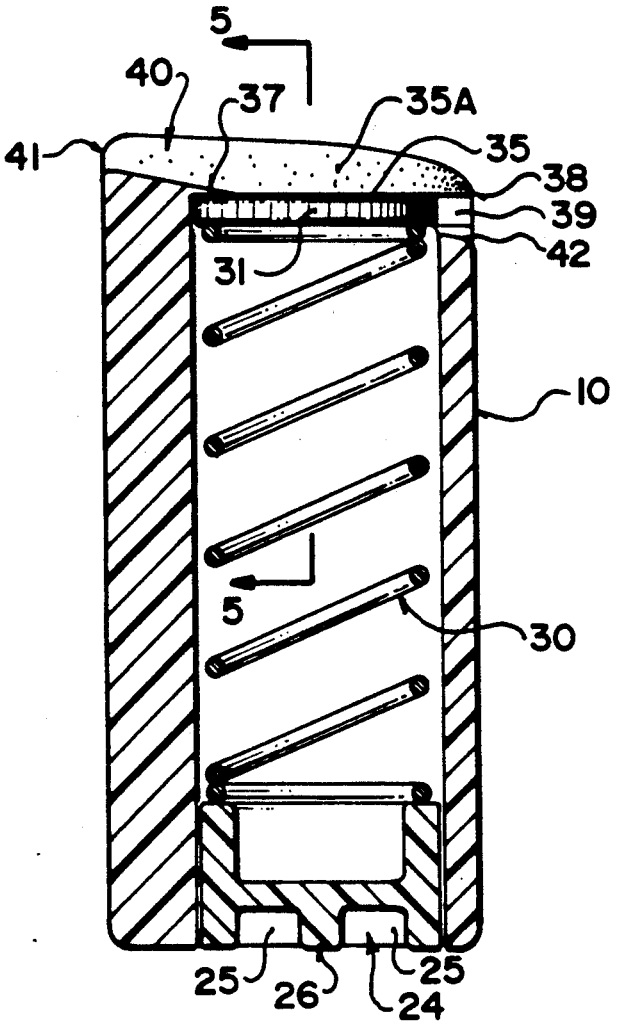
FIG. 4 is a cross sectional view along the lines 4—4 of FIG. 3.

As shown best in FIGS. 2 and 4, a plug member is provided for each of the four bores one of which is indicated at 24. The plug member comprises a cylindrical body which includes a pair of recesses 25 in the undersurface defining between them a rib 26 so that the fingers of the user can reach into the recesses and grasp the rib 26 enabling the plug to be readily turned about the axis of the bore for insertion and retraction from the bore. A locking mechanism for the plug member includes a pair of lugs 27 on the sides of the plug member. The lugs 27 can be inserted into a pair of channels 28 extending into the undersurface of the body parallel to the bore down to a short depth at which an angularly extending recess 29 is provided to receive the lug 27 as it is turned by a rotation of the plug member. The lugs and recesses thus define a bayonet fitting which enables the plug member to be simply inserted and turned to a locking position in which it is held by a frictional fit of the lugs within the recesses.

Figure 5:
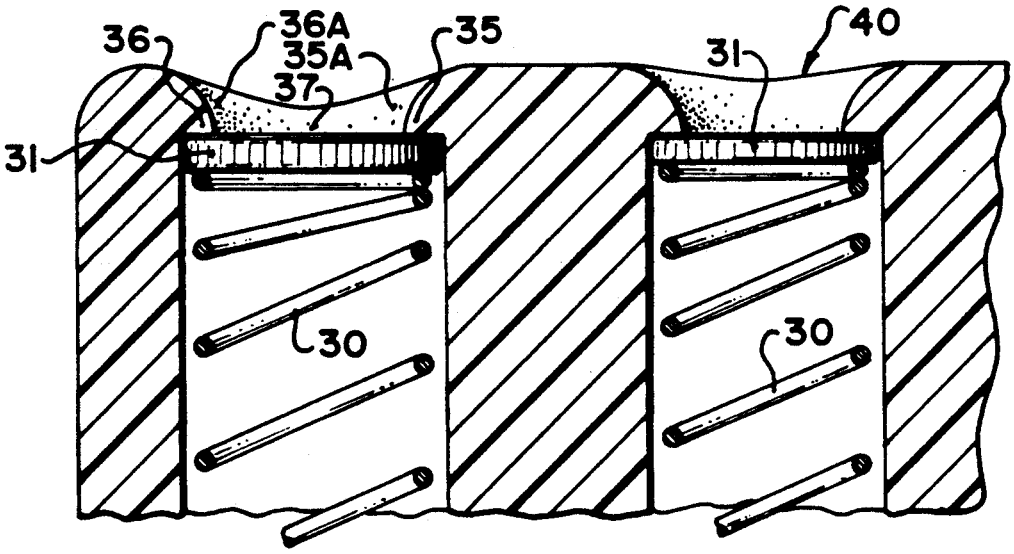
FIG. 5 is a cross sectional view along the lines 5—5 of FIG. 4.

A spring 30 is provided within each bore and has a lower end which engages an upper surface of the plug member 24 with the spring being of sufficient length so that it engages against any coins within the bore and presses them upwardly toward the upper surface. In FIGS. 4 and 5 an uppermost coin is indicated at 31. The spring is compressible so that the number of coins within the bore can vary from zero up to a maximum of the order of twenty-five with the coins arranged side by side along the length of the bore.

The upper surface of the body is shaped to confine the coins within the bore so that they are prevented from direct axial movement out of the end of the bore but to allow each coin to be dispensed singlely and in turn from the upper end of the bore by a sliding movement of the coin in a forward direction through the front surface of the body at its intersection with the upper surface.

For this purpose the upper surface at each of the bores is molded to define overhanging shoulders which project outwardly over the body of the coin to a position partly in from its outermost edge. Thus there are provided two side shoulders 35 and 36 which have a flat undersurface abutting directly against an upper side of the uppermost coin. In addition a rear shoulder 37 is provided which again has a flat undersurface contacting the upper surface of the coin. In this way the coin is confined around three sides with only the front side exposed.

The side shoulders 35 and 36 extend from the rear shoulder 37 forwardly to the front surface to a point indicated at 38 at which the shoulders terminate in the plane of the front surface. This acts to define a slot 39 in the front surface through which the uppermost coin can be withdrawn by a forward motion at right angles to the axis of the bore.

The upper surfaces of the shoulders 35, 36 and 37 are curved away from the innermost edge thereof to define the contoured upper surface shown particularly in FIGS. 1, 3, 4 and 5. The contoured surface includes a channel generally indicated at 40 which extends from the rear surface of the body forwardly over the rear shoulder, over the uppermost surface of the coin and through to the front surface. The channel commences at a shallow portion 41 thereof at the rear surface and gradually becomes deeper as it moves forwardly. The surface of the channel as best shown in FIG. 4 thus tapers gradually downwardly toward a sharp edge at the front of the shoulder 37, the sharp edge being indicated at 42 which is thus substantially contiguous with the upper surface of the coin.

The side shoulders 35 and 36 include inner faces 35A and 36A which are curved away from the upper surface of the coin at a sharper angle than the upper surface of the rear shoulder 37. The width of the shoulders 35 and 36 gradually decreases from a rearward end toward a forward end thereof at the front surface of the body. The channel defined along the upper surface of the shoulder 37 and along the inner faces 35A and 36A thus gradually increases in width toward the front surface.

The lower surface defining the slot 39 is chamfered downwardly at its intersection with the front surface 10 as indicated at 4. This increases the vertical height of the slot 39 at the front surface so that a coin can be inserted into the slot while inclined so that its rear edge is slightly higher than its front edge. Thus the coin can be inserted in a slightly upward direction so that it engages over the upper surface of the presently uppermost coin so that the new coin can take its place as the uppermost coin and press the present coin downwardly against the bias of the spring.

The removable plug members allow the user to insert a stack of coins for example when setting out initially to dispense change to a number of different people. Further coins can be inserted when received by the user through the upper end by the sliding action described above. The device can be emptied by dispensing the coins one at a time as described above or again by removing the plug member and dispensing all of the coins at one time.

The contour shaping of the upper surface provides a highly attractive appearance as opposed to the sharp utilitarian appearance of the conventional metal devices. The channel across the upper surface at each of the bores enables the user to slide a finger from the rear edge of the upper surface towards the forward edge of the upper surface so that the finger is guided by the channel and slides from the channel smoothly onto the upper surface of the coin at which point it can grasp the upper coin and slide the upper coin forwardly with the widening channel allowing more access by the finger of the user to the coin as the coin is moved forwardly.

The manufacture of the device as a unitary integral molding enables the device to be manufactured cheaply and from a very limited number of parts.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A device for holding and dispensing coins comprising a molded plastics body having an upper surface, a lower surface, a front surface and a rear surface and defining a plurality of cylindrical bores through the body in parallel spaced relation along the body with each bore having upper and lower ends breaking out on the upper and a lower surfaces respectively of the body, each bore having a cross section which is constant along at least the majority of its length and arranged to receive and closely surround a particular denomination of coin, the bores being arranged side-by-side across a width of the body so that the body includes a front surface of the body and a rear surface of the body lying generally parallel to each other, a plurality of plug members each arranged to cooperate with a respective one of the bores and with the lower surface of the body to extend into and to removably plug a lower end of the bore, and a plurality of spring means each arranged in a respective one of the bores in engagement with the respective plug member so as to bias upwardly toward the upper surface any coins within the bore, the upper surface being molded to define for each bore breaking out thereon a pair of side shoulder means for engaging an uppermost one of the coins in the bore so as to prevent axial movement of said uppermost coin out of the upper end of the bore, the front surface of the body at said upper surface being free from said shoulder means such that the uppermost coin can be slid forwardly from the bore under said side shoulder means in a direction at right angles to the axis of the bore to be released from the bore for dispensing, the side shoulder means extending across the upper surface to a front edge of the side shoulder means at the front surface, the upper surface being shaped to define for each bore a channel extending thereacross from a position at the rear surface and rearward of the bore to a position at the front surface and forward of the bore, side edges of the channel being defined by innermost side edges of the side shoulder means such that the channel intersects with an exposed portion of the uppermost coin, the channel increasing in depth from a rear surface toward the front surface so that the finger of the user is guided along the channel into contact with the coin, the channel increasing in width from the rear surface toward the front surface, the rear surface including a vertical flange member rearwardly of the rear surface and spaced therefrom such that the flange member can be attached over a belt of a user.

* * * * *